US009963920B2

(12) United States Patent
Cheever et al.

(10) Patent No.: US 9,963,920 B2
(45) Date of Patent: May 8, 2018

(54) DOOR SECURITY DEVICE

(71) Applicants: Alan D. Cheever, Overbrook, KS (US); Dustin Ryan Rojohn, Paola, KS (US)

(72) Inventors: Alan D. Cheever, Overbrook, KS (US); Dustin Ryan Rojohn, Paola, KS (US)

( * ) Notice: Subject to any disclaimer, the term of this patent is extended or adjusted under 35 U.S.C. 154(b) by 0 days. days.

(21) Appl. No.: 15/040,683

(22) Filed: Feb. 10, 2016

(65) Prior Publication Data

US 2016/0230435 A1 Aug. 11, 2016

Related U.S. Application Data

(60) Provisional application No. 62/176,154, filed on Feb. 10, 2015, provisional application No. 62/176,195, filed on Feb. 11, 2015.

(51) Int. Cl.

| | |
|---|---|
| ***E05C 17/44*** | (2006.01) |
| ***E05C 17/54*** | (2006.01) |
| ***E05C 19/18*** | (2006.01) |

(52) U.S. Cl.

CPC ..... *E05C 17/54* (2013.01); *E05C 19/184* (2013.01); *Y10S 292/15* (2013.01); *Y10T 292/11* (2015.04); *Y10T 292/71* (2015.04)

(58) Field of Classification Search

CPC ..... E05C 17/54; E05C 17/00; E05C 17/02; E05C 19/18; E05C 17/56; Y10T 292/34; Y10T 292/37; Y10T 292/65; Y10T 292/67; Y10T 292/71; Y10T 292/73; Y10T 292/11; Y10S 292/15

USPC ..... 292/288, 289, 338, 339, 342, 343, 292/DIG. 15, 251.5; 49/394; 248/351

See application file for complete search history.

(56) References Cited

U.S. PATENT DOCUMENTS

| | | | | | |
|---|---|---|---|---|---|
| 177,102 | A * | 5/1876 | Daniels | E05C 17/54 | 292/343 |
| 1,037,439 | A * | 9/1912 | Coffin | E05C 19/18 | 292/288 |
| 1,119,650 | A * | 12/1914 | Smith | E05C 17/54 | 292/343 |
| 1,473,926 | A * | 11/1923 | Emslie | E05C 17/54 | 292/342 |

(Continued)

FOREIGN PATENT DOCUMENTS

| | | | | |
|---|---|---|---|---|
| DE | 333282 C * | 2/1921 | ..... | E05C 17/54 |
| DE | 29711966 U1 * | 9/1997 | ..... | E05C 17/54 |

(Continued)

*Primary Examiner* — Christine M Mills

(74) *Attorney, Agent, or Firm* — Lathrop Gage L.L.P.

(57) ABSTRACT

A door lock has a base, a wedge, and two pins. The base has an engaging end that has two holes and is wider than a base abutting end. The wedge extends upwardly from the. The two pins are configured to pass through the base holes and apertures in a floor surface to secure the base to the floor surface. An outermost edge of each of the base holes is laterally outside opposite sides of the wedge. In another embodiment, a door lock includes a base, a wedge, two pins, and a magnet. The base has an engaging end has two holes and is wider than a base abutting end. The pins are configured to pass through the base holes and apertures in the floor surface to temporarily secure the base to the floor surface. The magnet selectively biases the pins to the base when the base is not engaged.

18 Claims, 18 Drawing Sheets

(56) References Cited

U.S. PATENT DOCUMENTS

| | | | | | |
|---|---|---|---|---|---|
| 2,122,312 | A * | 6/1938 | Cassion | E05C 17/54 | 292/342 |
| 3,833,963 | A * | 9/1974 | Waters | E05C 17/54 | 16/82 |
| 3,977,714 | A * | 8/1976 | Trotter | E05C 17/54 | 16/86 R |
| 5,163,308 | A * | 11/1992 | Lillo | E05B 67/38 | 70/100 |
| 5,199,759 | A | 4/1993 | Anderson | | |
| 5,383,254 | A * | 1/1995 | Wigley, Sr. | E05B 65/0894 | 16/82 |
| 5,454,610 | A | 10/1995 | Taylor et al. | | |
| 5,456,506 | A * | 10/1995 | Bartlett | E05C 19/08 | 16/223 |
| 5,711,560 | A | 1/1998 | Gilbertson | | |
| 6,161,252 | A | 12/2000 | Rodriguez | | |
| 6,345,849 | B1 * | 2/2002 | Yen | E05C 17/54 | 292/292 |
| 6,557,912 | B1 * | 5/2003 | Truong | E05C 17/50 | 292/338 |
| 8,727,400 | B1 * | 5/2014 | Marchand | E05B 65/0888 | 292/259 R |
| 2012/0080891 | A1 * | 4/2012 | Bravo | E05C 17/443 | 292/251.5 |
| 2014/0001775 | A1 * | 1/2014 | Mullenbach | E05C 19/188 | 292/288 |
| 2014/0312634 | A1 * | 10/2014 | Cushwa, Jr. | E06B 5/10 | 292/340 |

FOREIGN PATENT DOCUMENTS

| | | | | |
|---|---|---|---|---|
| FR | 2729705 | A1 * | 7/1996 | E05C 19/184 |
| GB | 2030639 | A | 4/1980 | |
| JP | 06330665 | A * | 11/1994 | E05B 65/0894 |

* cited by examiner

DOOR SECURITY DEVICE

RELATED APPLICATION

This application claims the benefit of priority to U.S. Provisional Application No. 62/176,154 filed Feb. 10, 2015, and U.S. Provisional Application No. 62/176,195 filed Feb. 11, 2015, the contents of which are incorporated herein in their entirety by reference.

BACKGROUND

Security issues in both public and private buildings have become widespread in recent years, as is evidenced by shootings at Sandy Hook, Virginia Tech, San Bernardino, and many other locations. With door locks, occupants benefit from an additional safety measure to prevent undesired and sometimes lethal entry into a room.

The door locks disclosed herein may transform a classroom, office, or other location into a safe room if used when a suspected intruder is nearby, and a user may only need to apply a small amount of effort to transform a room into a safe room; thus averting injury or possible death of the room's occupants.

The present disclosure relates generally to door locks and, more specifically, to door locks that interact with a floor to prevent entry through a door.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere.

In one embodiment, a door lock includes a base, a wedge, and two pins. The base has an abutting end and an engaging end, the engaging end being wider than the abutting end and having two holes where an outermost edge of each of the base holes is laterally outside opposite sides of the wedge. The wedge extends upwardly from the base and has a tapered end that is generally adjacent the abutting end of the base. The pins are configured to pass through the holes in the base and apertures in a floor surface to temporarily secure the base to the floor surface.

In another embodiment, a door lock includes a base, a wedge, two pins, and a magnet. The base has an abutting end and an engaging end, the engaging end being wider than the abutting end and having two holes. The wedge extends upwardly from the base, and a tapered end of the wedge is generally adjacent the abutting end of the base. The two pins are coupled to one another and are each configured to pass through a base hole and an aperture in the floor surface to secure the base to the floor. The magnet imparts a magnetic field above the base engaging end to selectively bias the pins to the base. The wedge is positioned between the pins when the pins are biased to the base by the magnetic force.

DETAILED DESCRIPTION

Figure 1:
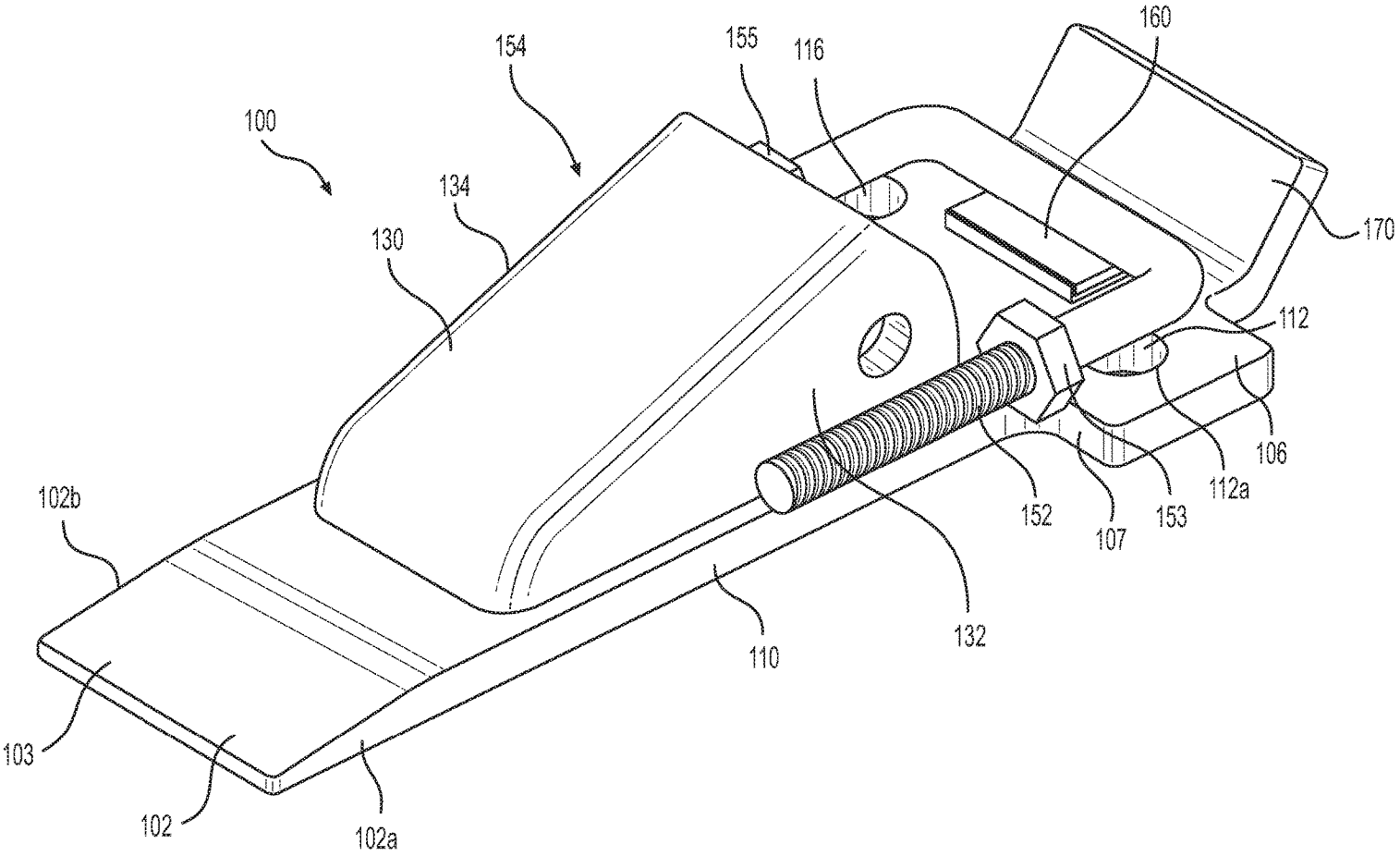
FIG. 1 is a perspective view of a door lock, showing the pins biased to the base.

FIGS. 1 through 10 show a door lock 100 according to one embodiment of the current invention. The door lock 100 broadly includes a base 110, a wedge 130, and two pins 152, 154.

As shown in FIG. 1, the base 110 has an abutting end 102 and an engaging end 106. The abutting end 102 has opposite sides 102*a*, 102*b* which may be generally parallel to one another, and the abutting end 102 may have a taper 103. The engaging end 106 is wider than the abutting end 102 and extends outwardly from the sides 102*a*, 102*b* of the abutting end 102. The engaging end 106 may have a forward edge 107 that is generally perpendicular to the opposite sides 102*a*, 102*b* of the abutting end 102.

Figure 2:
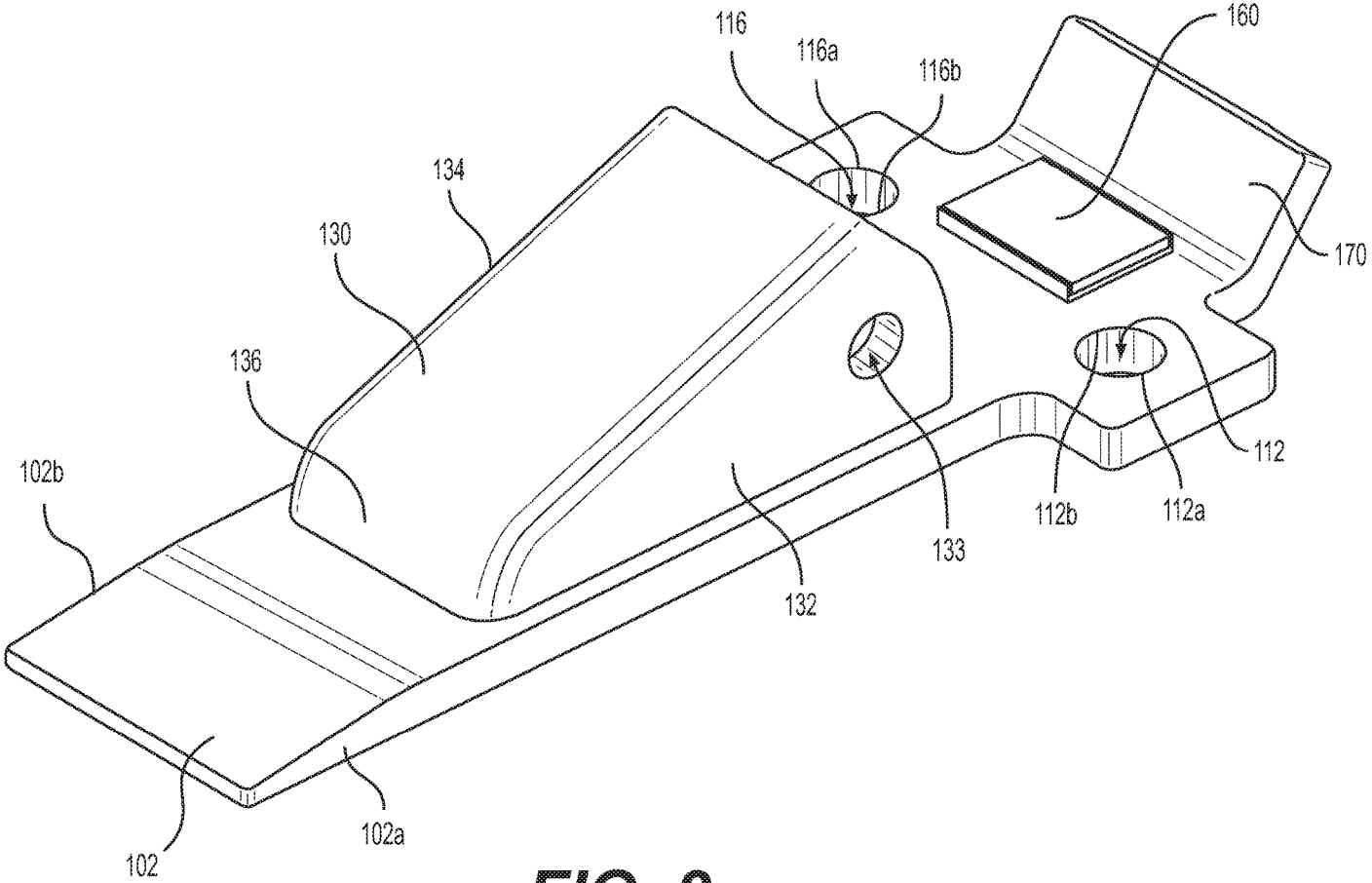
FIG. 2 is a perspective view of the door lock of FIG. 1, shown without the pins.
Figure 3:
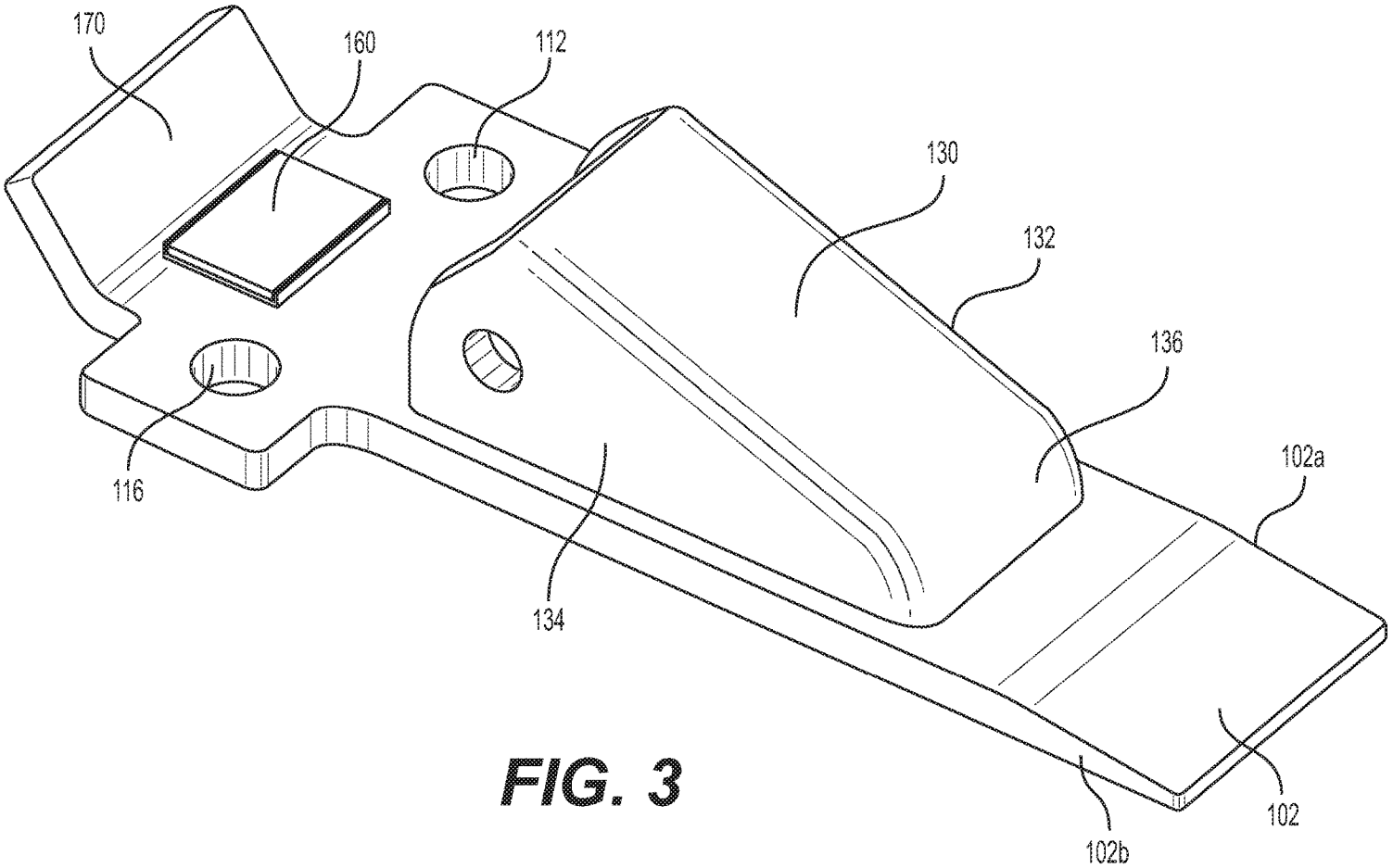
FIG. 3 is another perspective view of the door lock of FIG. 1.
Figure 4:
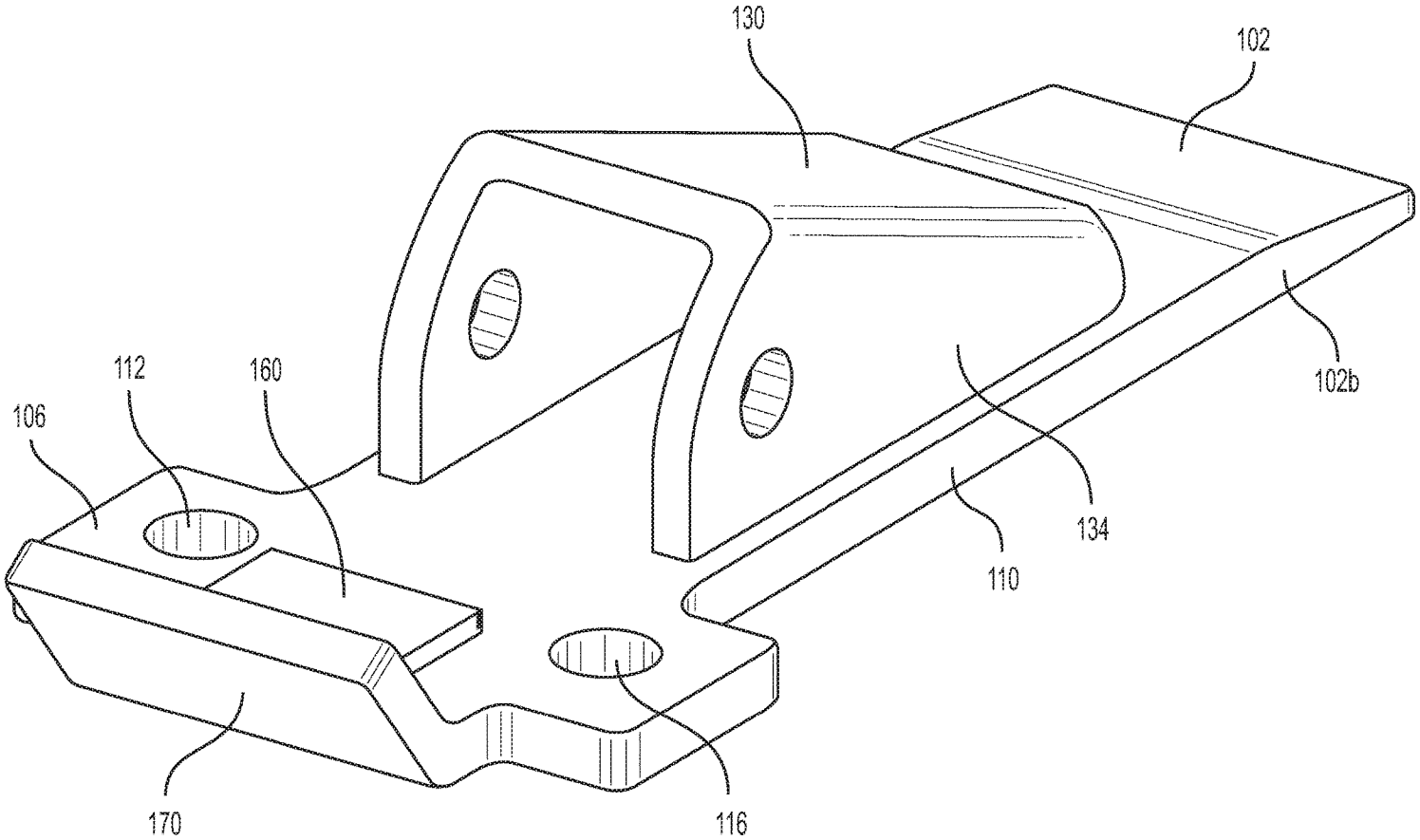
FIG. 4 is yet another perspective view of the door lock of FIG. 1.
Figure 5:
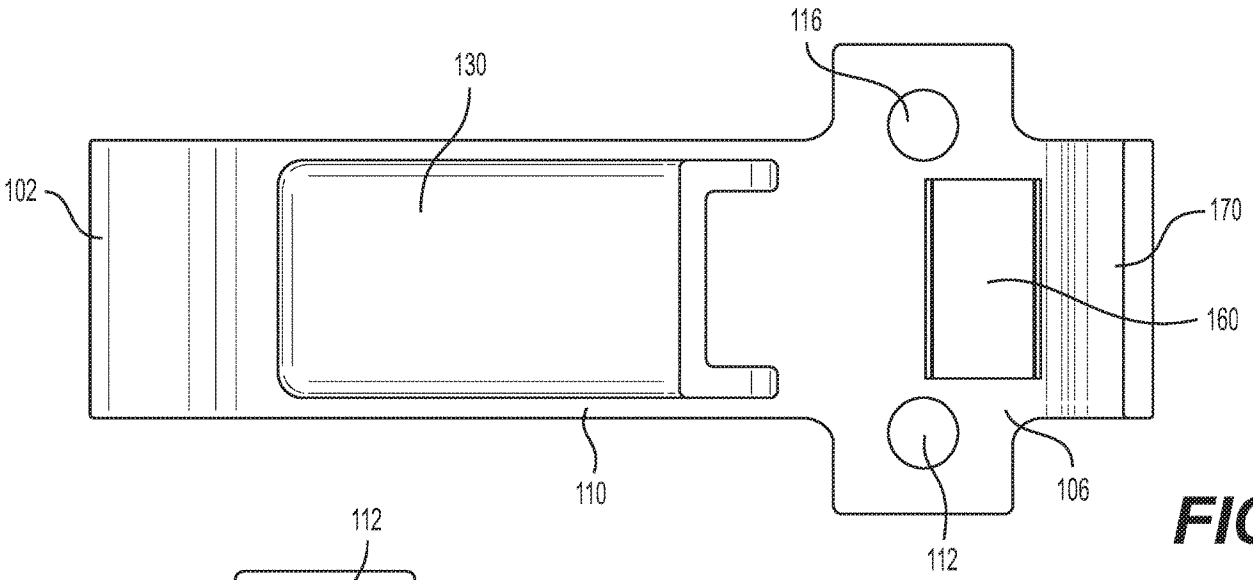
FIG. 5 is a top view of the door lock of FIG. 1.
Figure 6:
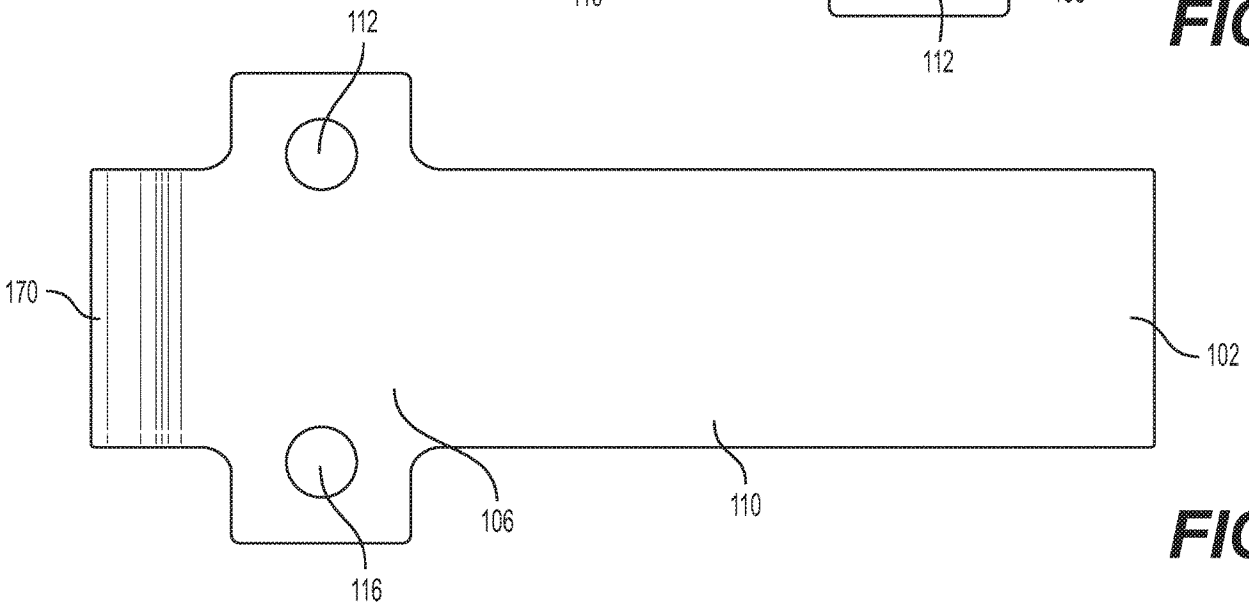
FIG. 6 is a bottom view of the door lock of FIG. 1.
Figure 7:
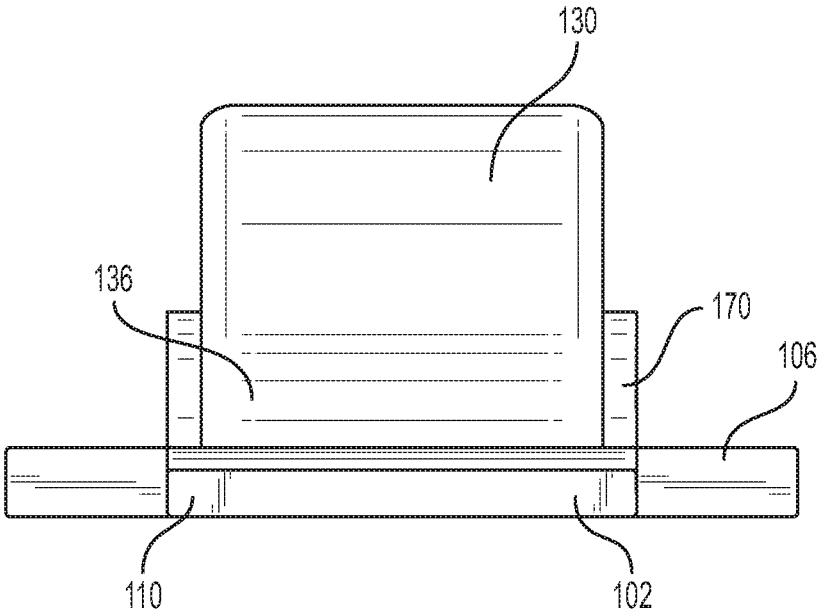
FIG. 7 is a front view of the door lock of FIG. 1.
Figure 8:
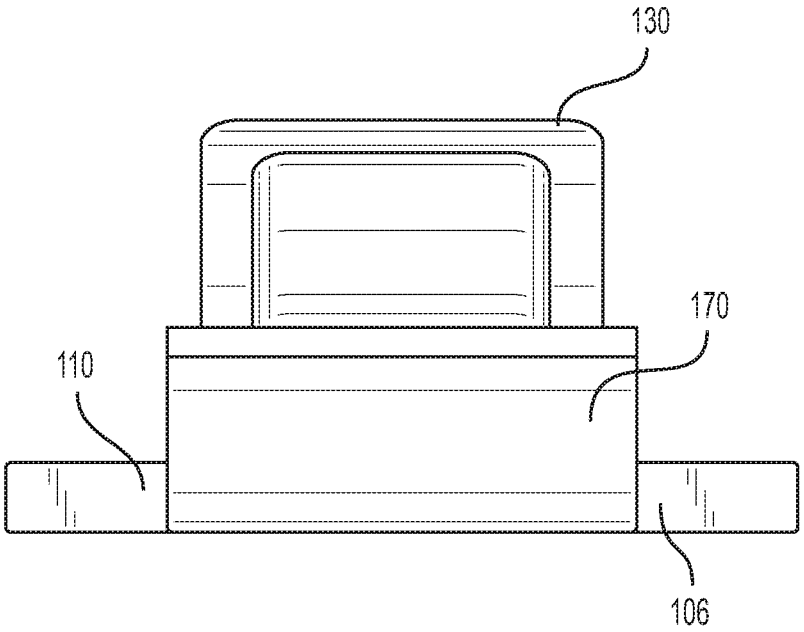
FIG. 8 is a back view of the door lock of FIG. 1.
Figure 9:
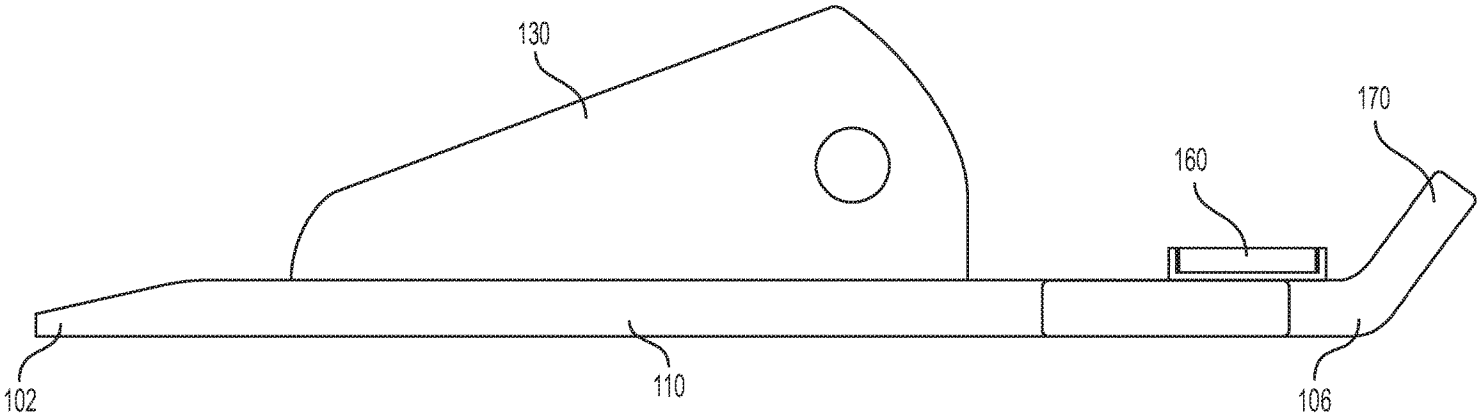
FIG. 9 is a side view of the door lock of FIG. 1.
Figure 10:
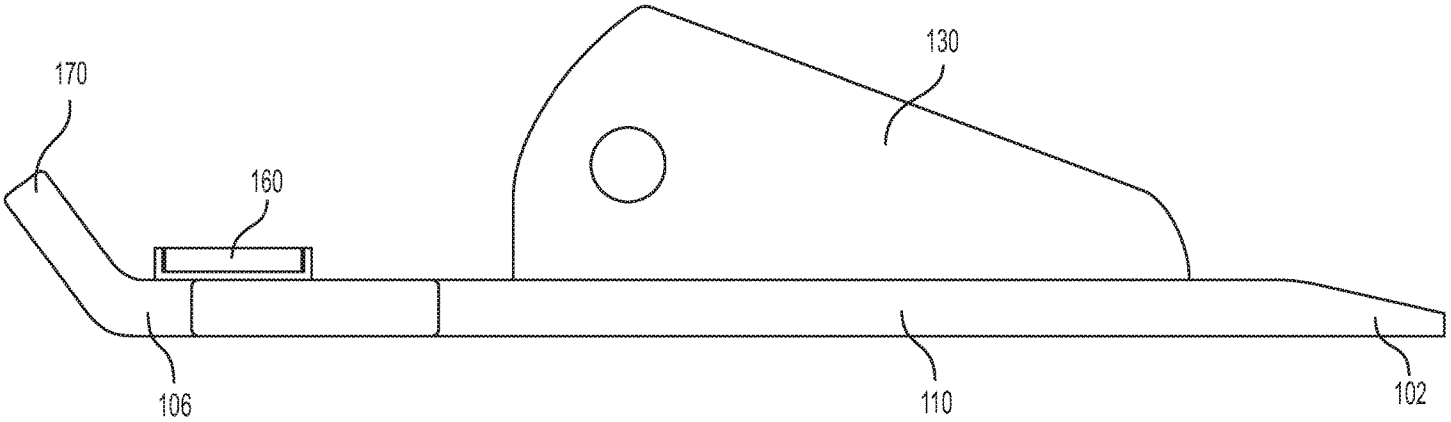
FIG. 10 is an opposite side view of the door lock of FIG. 1.

As shown in FIG. 2, two holes 112, 116 are disposed in the engaging end 106. An outermost edge 112*a*, 116*a* of each hole 112, 116 may be outside opposite sides 132, 134 of the wedge 130 and outside the opposite sides 102*a*, 102*b* of the base abutting end 102. An innermost edge 112*b*, 116*b* of each hole 112, 116 may be inside the opposite sides 102*a*, 102*b* of the base abutting end 102. The base 110 may be constructed of any appropriate material, such as steel, aluminum, and other metals and composites.

Turning to the wedge 130, the tapered end 136 of the wedge 130 is generally adjacent the taper 103 of the abutting end 102 of the base 110. It may be particularly desirable for the wedge 130 to be hollow, and apertures 133, 135 in the wedge sides 132, 134 may reduce a weight of the wedge 130 and serve as attachment points whereby items may be tethered to the wedge 130. The wedge may be constructed of any appropriate material, such as steel, aluminum, and other materials and composites. The wedge 130 may be attached to the base 110 (e.g., by adhesive, welding, bolting, etc.) or may be formed integrally with the base 110.

Figure 13:
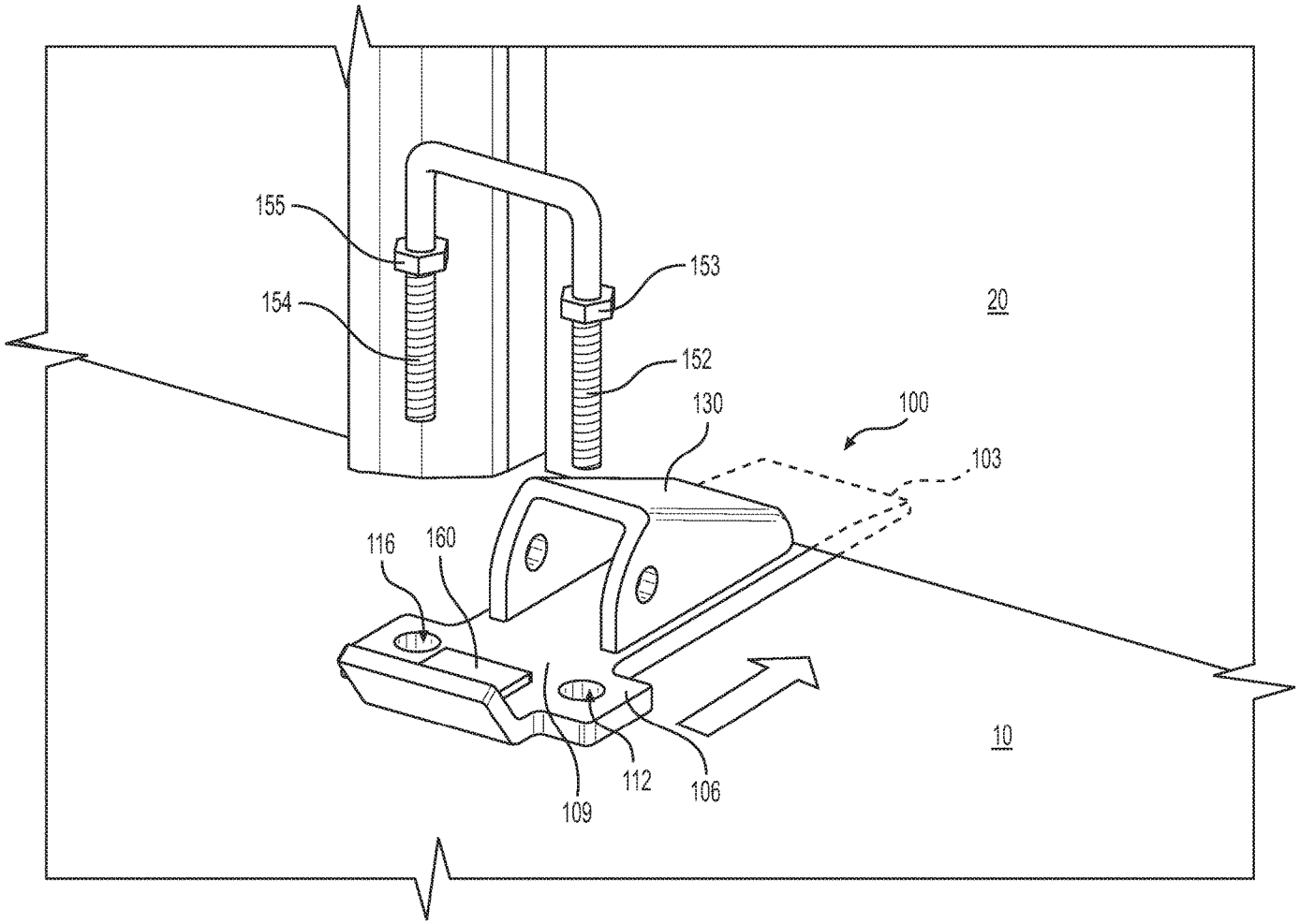
FIG. 13 is a perspective view showing the door lock of FIG. 1 interacting with the door and the floor, with the pins positioned above the door lock.

The pins 152, 154 (FIGS. 1, 13, 14) are configured to pass through the holes 112, 116 and respective apertures 12, 16 in a floor surface 10 to secure the base 110 to the floor surface 10. As shown in FIG. 13, the pins 152, 154 may be coupled to one another, such as in a U-shape as shown. Stops 153, 155 may be configured to interact with an upper surface 109 of the base engaging end 106 without passing through the holes 112, 116, which in turn limits an amount of travel for the pins 152, 154 into the holes 112, 116 and the floor apertures 12, 16.

Steel sleeves may be placed in the floor apertures 12, 16 to secure the apertures 12, 16 and provide an interior for engaging with the pins 152, 154. The steel sleeves may further aid in keeping the pins 152, 154 secure when engaged with the floor surface 10. Caps or other covers may overlay the steel sleeves when the pins 152, 154 are not engaged to keep dirt and debris from entering the sleeves so that the apertures 12, 16 remain clear. Use of the steel sleeves may be preferable to other methods or ways of securing the apertures 12, 16, such as a floor plate. The steel sleeves may be easier to install, more cost effective, require fewer materials, and maintain a clear walkway through the door.

The door lock 100 may also have a magnet 160. As shown in FIG. 2, the magnet 160 is fixed to the engaging end 106 of the base 110 (e.g. between the two holes 112, 116). As shown in FIG. 1, the magnet 160 may be used to bias the pins 152, 154 to the base 110 using a magnetic field when the pins 152, 154 are not engaged with the floor surface 10. This allows for easy storage of the door lock 100, and aids in preventing loss or misplacement of the pins 152, 154. Having the pins 152, 154 biased to the base 110 with the magnet 160 also allows for rapid engagement of the door lock 100, as the base 110 and the pins 152, 154 are not stored in two separate places and may be separated only during the moments preceding engagement. The magnetic field caused by the magnet 160 may interact with the stops 153, 155 and bias the pins 152, 154 to the base 110 while the pins 152, 154 are engaged with the base 110 to temporarily secure the base 110 to the floor surface 10. The magnet 160 may be round, square, rectangular, triangular, or any other desired shape. The magnet 160 may be attached to the base 110 by adhesive, bolting, welding, or any appropriate method known in the art, whether now known or later developed. The handle 170 may preferably extend above the magnet 160 and below an uppermost point of the wedge 130. In one embodiment, the handle 170 is between one half and three inches long. The handle 170 may extend upwardly and outwardly from the base 110 at an angle between twenty-five and eighty-five degrees from horizontal. It may be desirable for the handle 170 to extend upwardly and outwardly from the base 110 at an angle between forty-five and seventy-five degrees from horizontal, and even more desirable for the handle 170 to extend upwardly and outwardly from the base 110 at an angle of about sixty degrees from horizontal. A width of the handle 170 may be less than a width of the base engaging end 106, such that the handle 170 does not extend along the entire width of the base engaging end 106. The handle 170 may be constructed of any appropriate material, such as steel, aluminum, and other metals and composites. The handle 170 may be attached to the base 110 (e.g., by adhesive welding, bolting, etc.) or may be formed integrally with the base 110.

Figure 11:
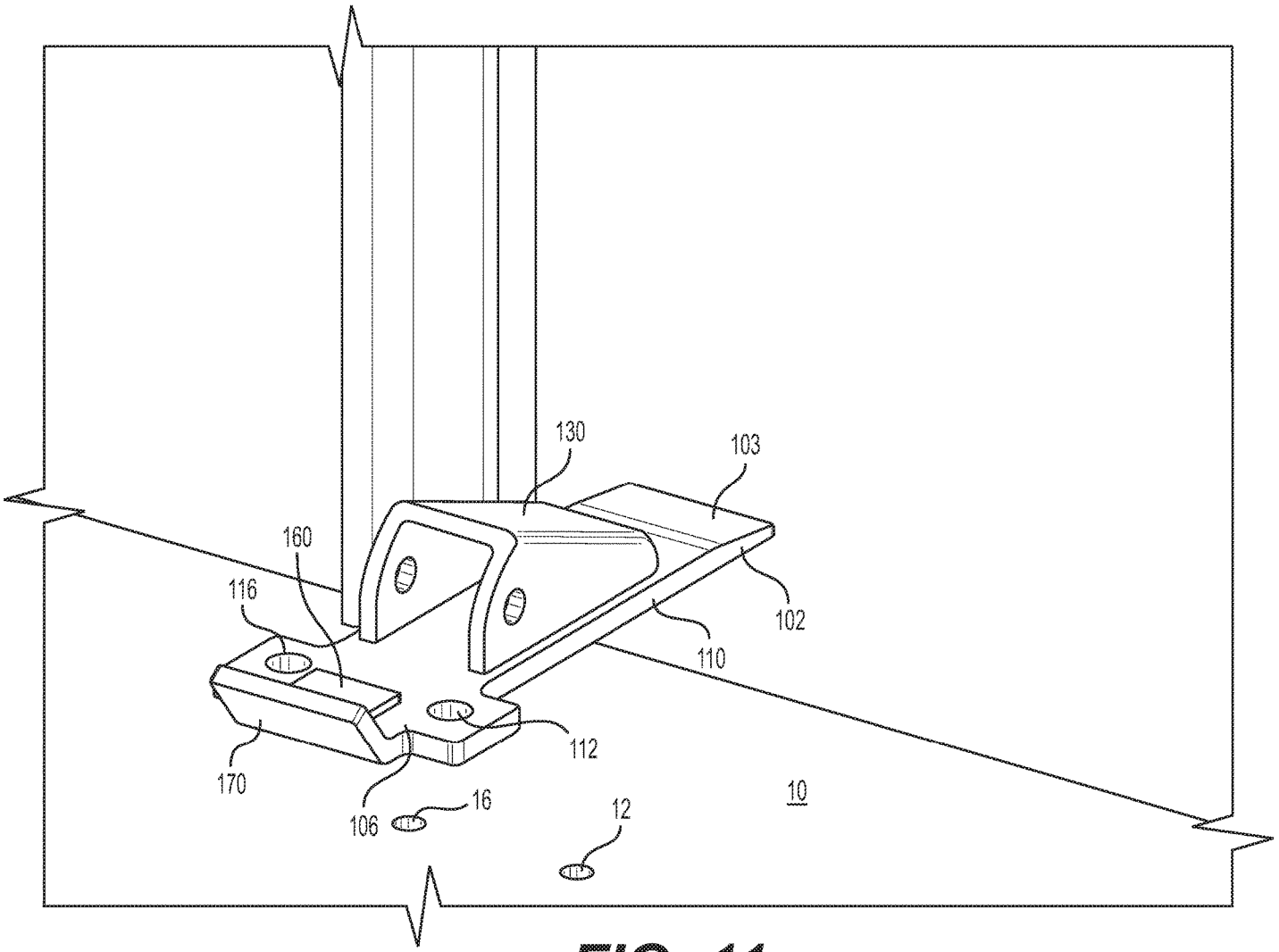
FIG. 11 is a perspective view showing the door lock of FIG. 1 with a door and a floor surface.
Figure 12:
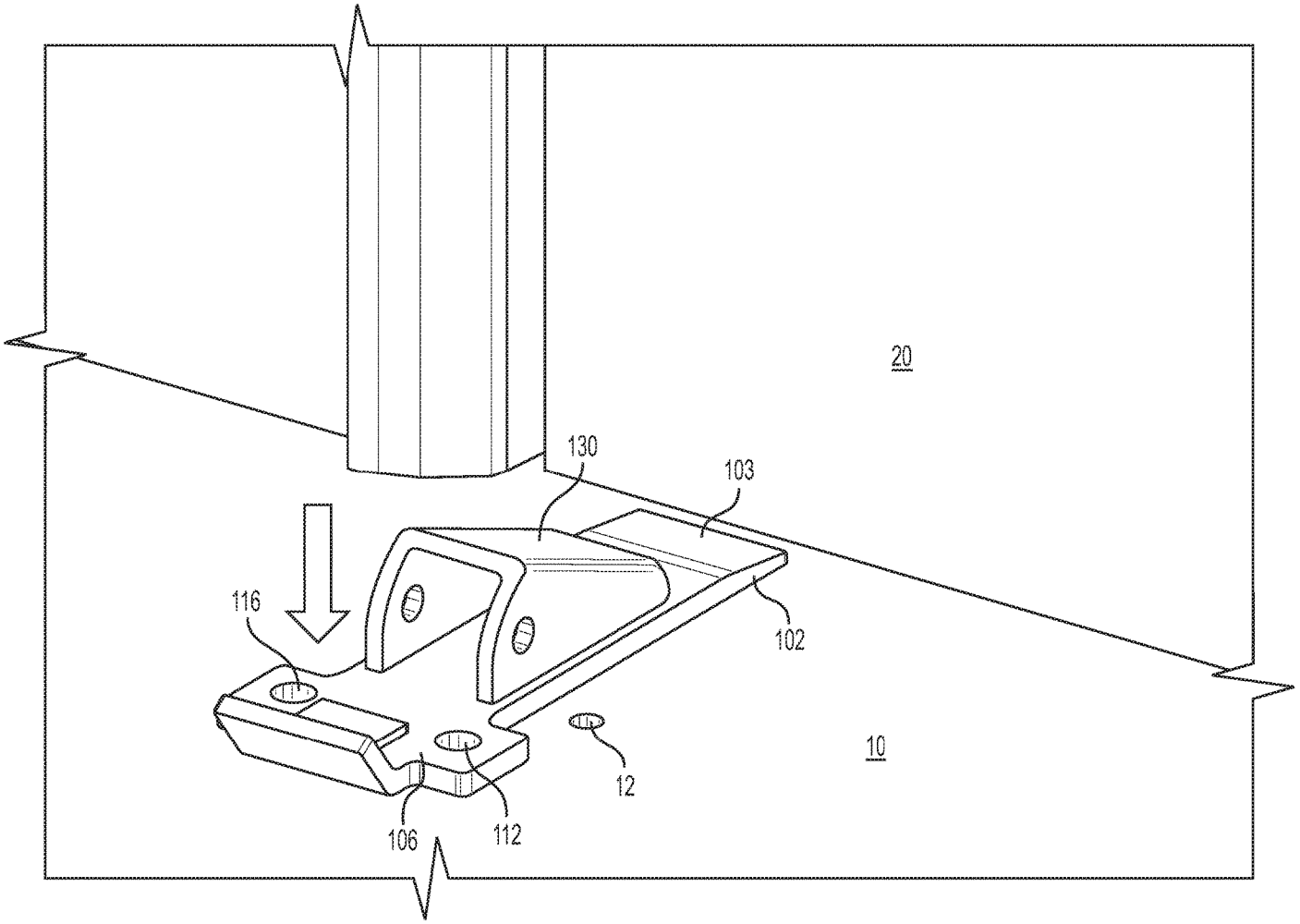
FIG. 12 is another perspective view showing the door lock of FIG. 1 being lowered to the floor surface.
Figure 14:
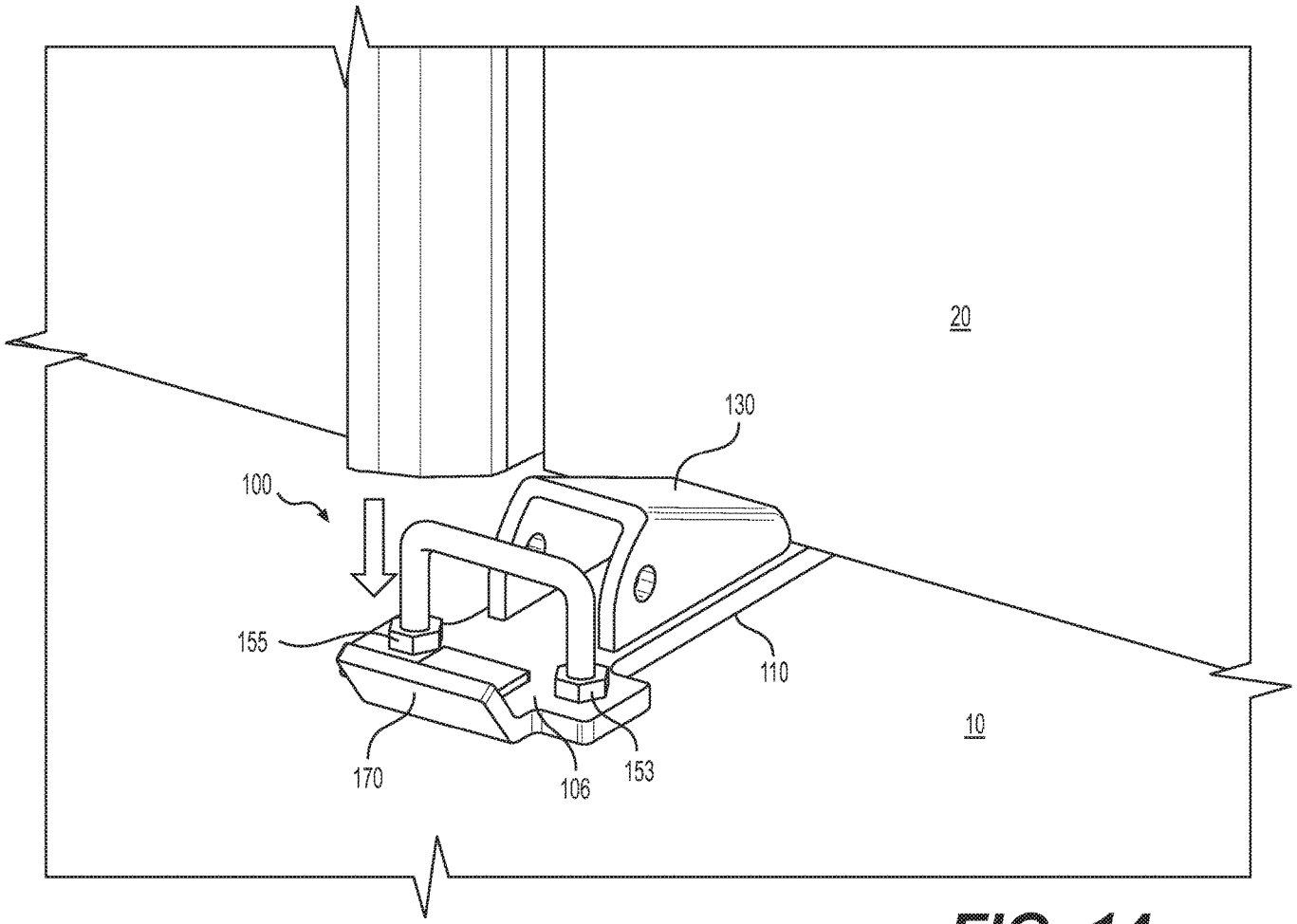
FIG. 14 is a perspective view showing the door lock of FIG. 1 in use with the pins engaged.
Figure 15:
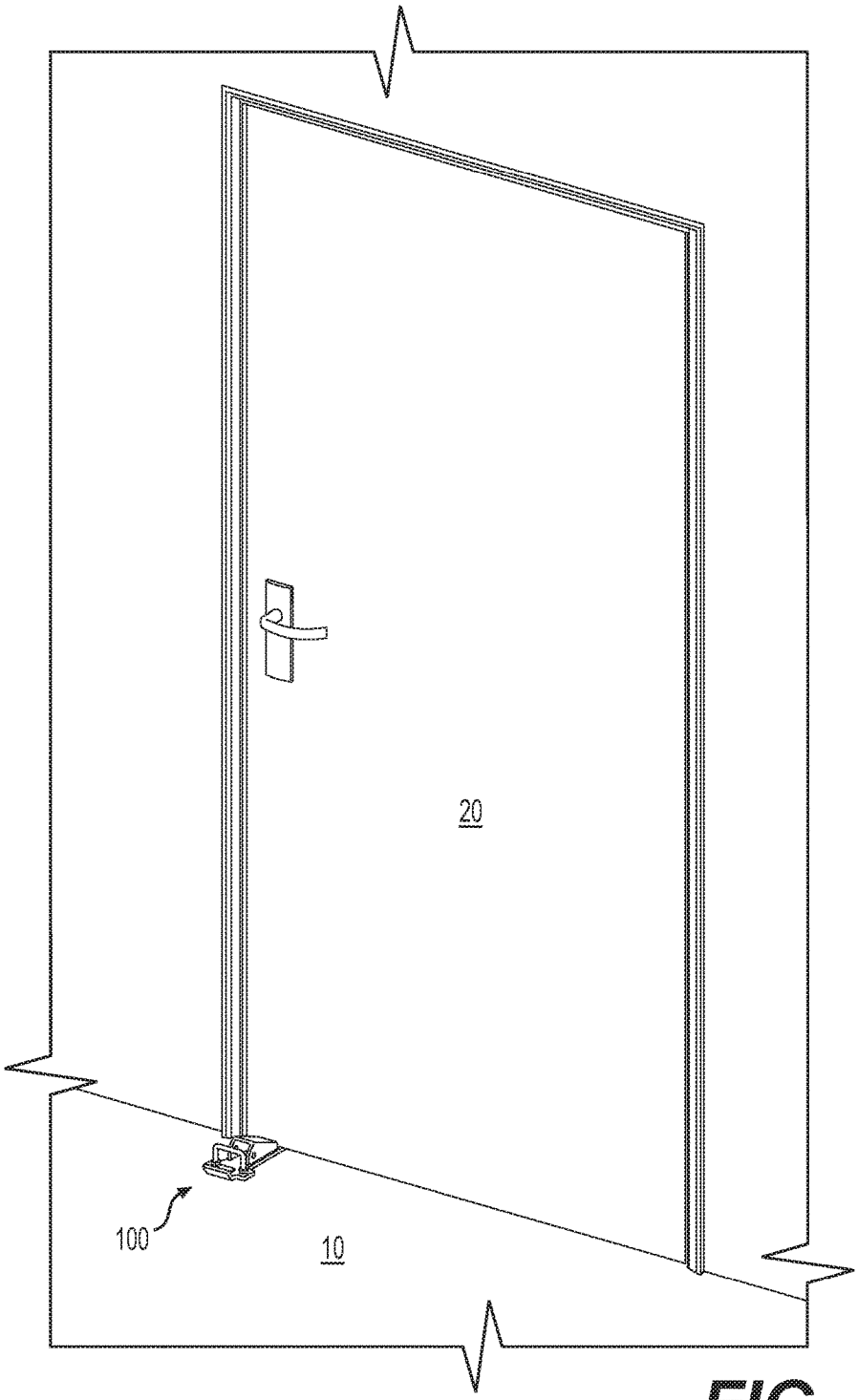
FIG. 15 is another perspective view showing the door lock of FIG. 1 engaged with the door.

FIGS. 11-15 show the door lock 100 engaging or preparing to engage with a floor surface 10 and a door 20. FIG. 11 shows the base 110 near the floor 10 and the apertures 12, 16. As shown in FIG. 12, the door lock 100 is lowered the floor 10, preferably near the apertures 12, 16 in the floor surface 10. As shown in FIG. 13, to the door lock 100 is positioned so that the wedge 130 contacts the door 20 and the taper 103 is below the door 20, and the holes 112, 116 in the base 110 and the apertures 12, 16 in the floor surface 10 align. The pins 152, 154 can then be inserted through the holes 112, 116 and the apertures 12, 16 to secure the base 110 into position against the closed door 20 (FIGS. 14 and 15). The steel sleeves may further reinforce the receiving point of the pins 152, 154. When engaged, the position of the door lock 100 against the door 20 may provide added stability against dislodging or a potential unauthorized entrance into a room.

The illustrated base engaging end 106 is wider than the base abutting end 102. The placement of the holes 112, 116 in the base engaging end 106 to be used in connection with corresponding pins 152, 154 contributes to increase stability and immobility of the base 110. Having a wider base engaging end 106 allows placement of the dual holes 112, 116 to be further apart, which may provide added strength to the pins 152, 154, and thereby added immobility to the door lock 100 while it is engaged. Specifically, the widened base engaging end 106 and the dual pins 152, 154 engaged with the base holes 112, 116 may prevent the base 110 from undergoing any pivoting motion. Thus, a person seeking unauthorized entrance into a room may not be able to move or pivot the wedge 130 from the door 20 and thereby dislodge the door lock 100. It is foreseen that the number of holes also contributes to the stability and immobility of door lock 100.

Figure 16:
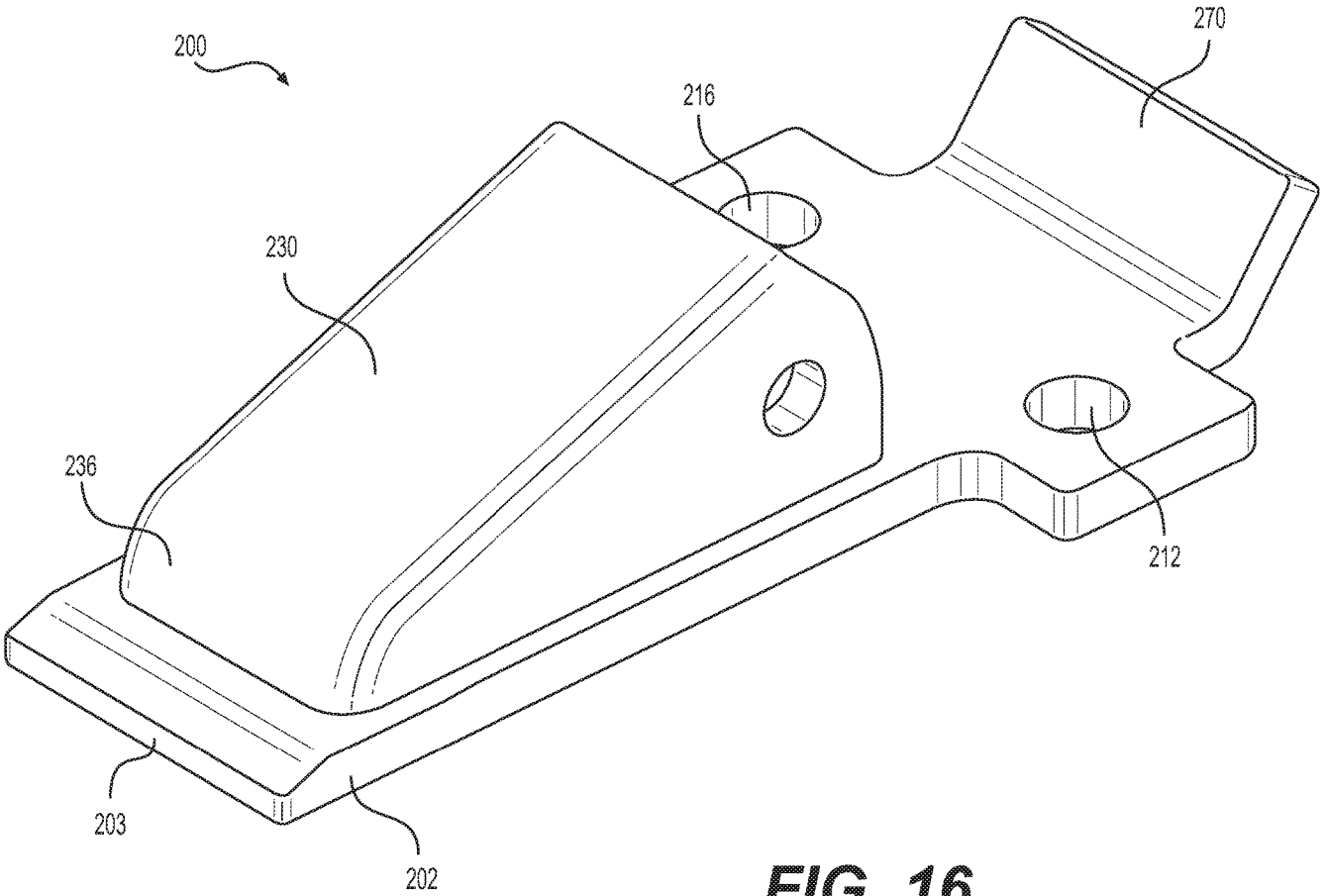
FIG. 16 is a perspective view of another embodiment of a door lock.

FIG. 16 shows another door lock 200 that is substantially similar to the door lock 100, except as specifically noted and/or shown, as would be inherent. Further, those skilled in the art will appreciate that the door lock 100 (and thus the door lock 200) may be modified in various ways, such as incorporating all or part of any of the various described embodiments, for example. For uniformity and brevity, reference numbers between 200 and 299 may be used to indicate parts corresponding to those discussed above numbered between 100 and 199 (e.g., base 210 corresponds general to the base 110), though with any noted or shown deviations.

The door lock 200 has a base 210 that has an abutting end 202 that is less than an inch in length as it extends from a tapered end 236 of a wedge 230. A shortened abutting end 202 may be preferable if the door 20 has a threshold or extends very near to the floor 10.

Figure 17:
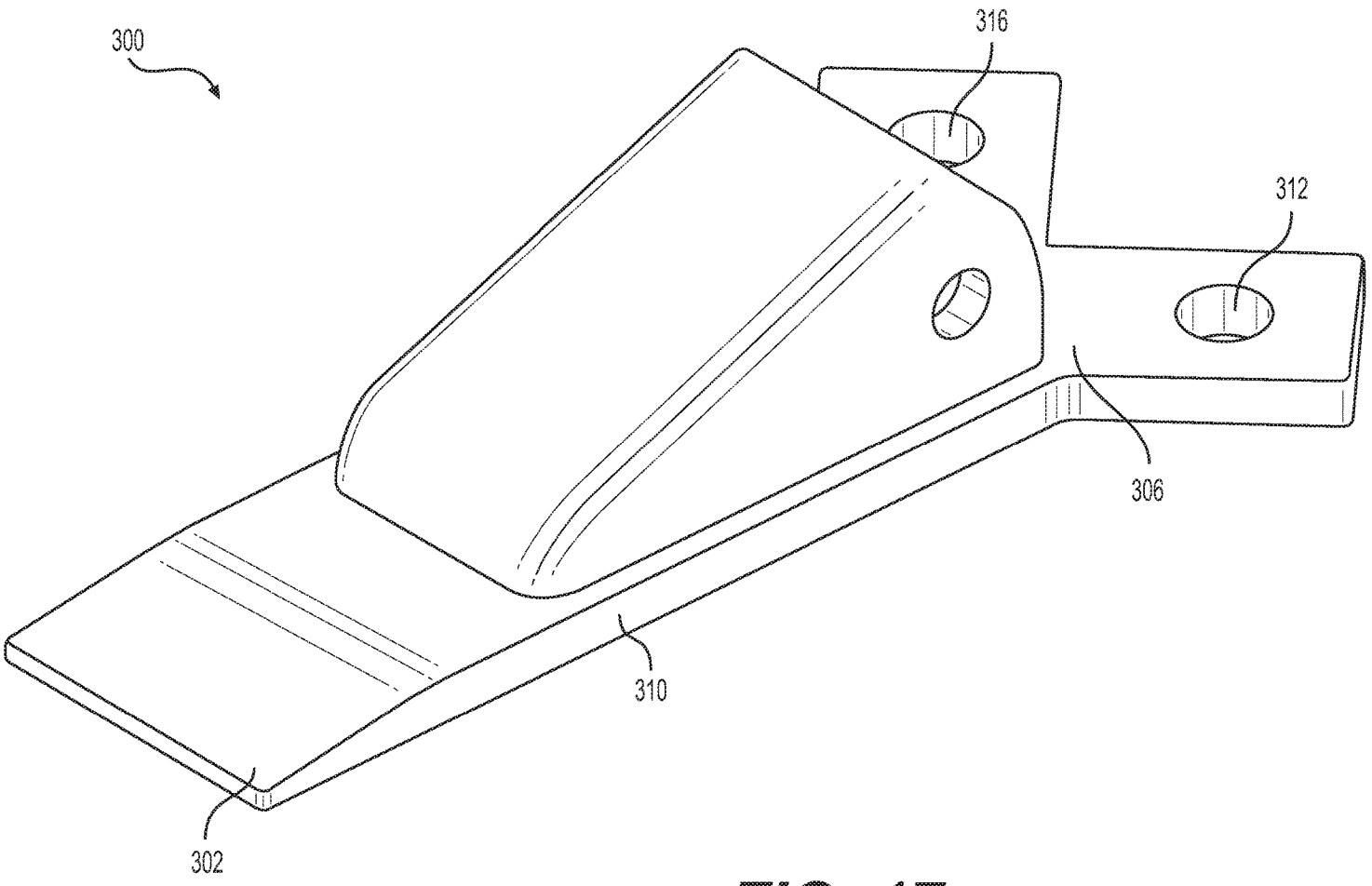
FIG. 17 is a perspective view of still another embodiment of a door lock.

FIG. 17 shows another door lock 300 that is substantially similar to the door lock 100, except as specifically noted and/or shown, as would be inherent. Further, those skilled in the art will appreciate that the door lock 100 (and thus the door lock 300) may be modified in various ways, such as incorporating all or part of any of the various described embodiments, for example. For uniformity and brevity, reference numbers between 300 and 399 may be used to indicate parts corresponding to those discussed above numbered between 100 and 199 (e.g., base 310 corresponds general to the base 110), though with any noted or shown deviations.

The door lock 300 has a base 310 that has an engaging end 306 is V-shaped. Two holes 312, 316 are disposed in the base engaging end 306. The holes 312, 316 may be preferably disposed on each end of the V.

Figure 18:
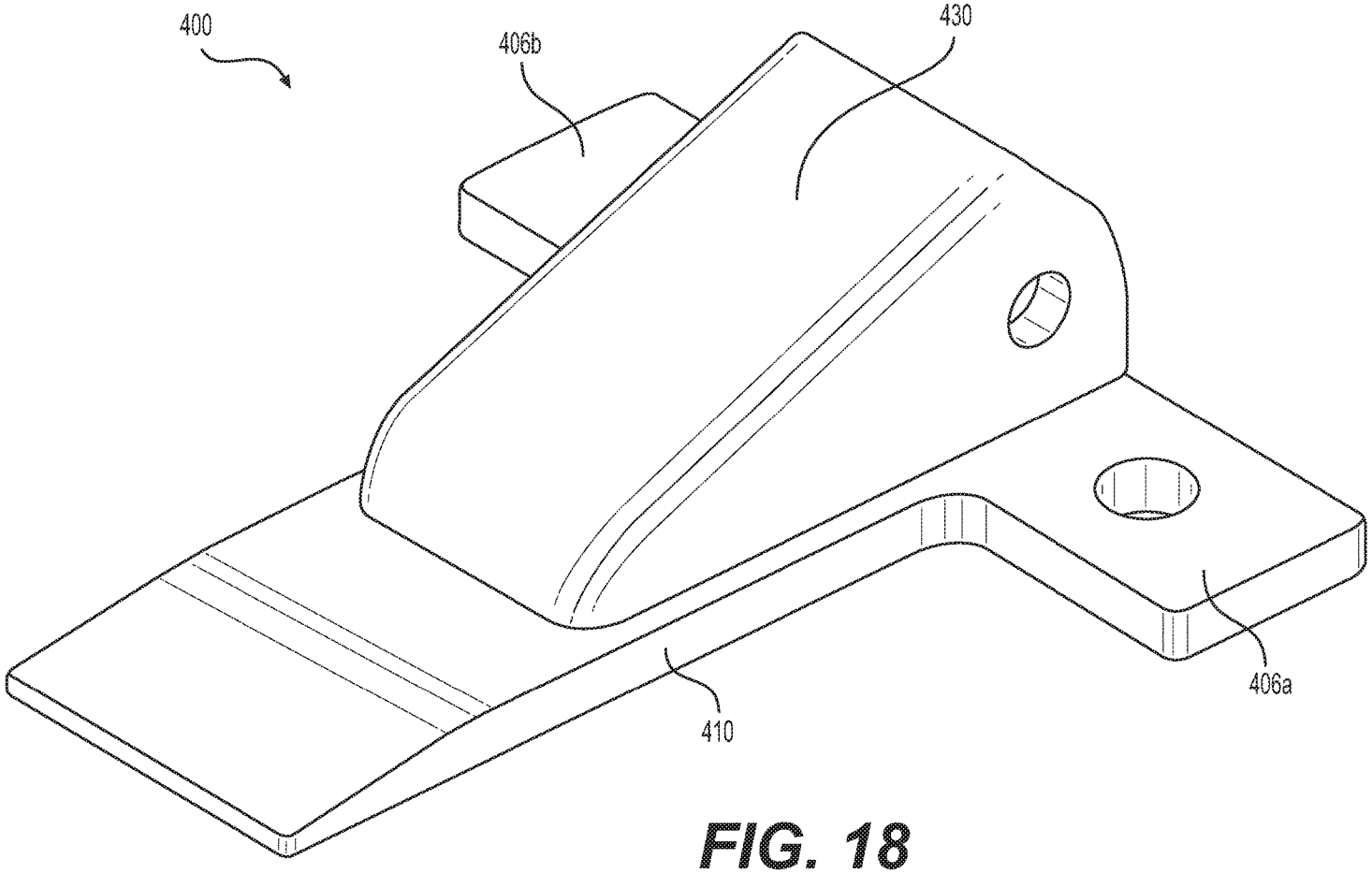
FIG. 18 is a perspective view of yet another embodiment of a door lock.

FIG. 18 shows another door lock 400 that is substantially similar to the door lock 100, except as specifically noted and/or shown, as would be inherent. Further, those skilled in the art will appreciate that the door lock 100 (and thus the door lock 400) may be modified in various ways, such as incorporating all or part of any of the various described embodiments, for example. For uniformity and brevity, reference numbers between 400 and 499 may be used to indicate parts corresponding to those discussed above numbered between 100 and 199 (e.g., base 410 corresponds general to the base 110), though with any noted or shown deviations.

The door lock 400 has a base 410 that has two engaging ends 406*a*, 406*b*. The engaging ends 406*a*, 406*b* are lateral a wedge 430.

Figure 19:
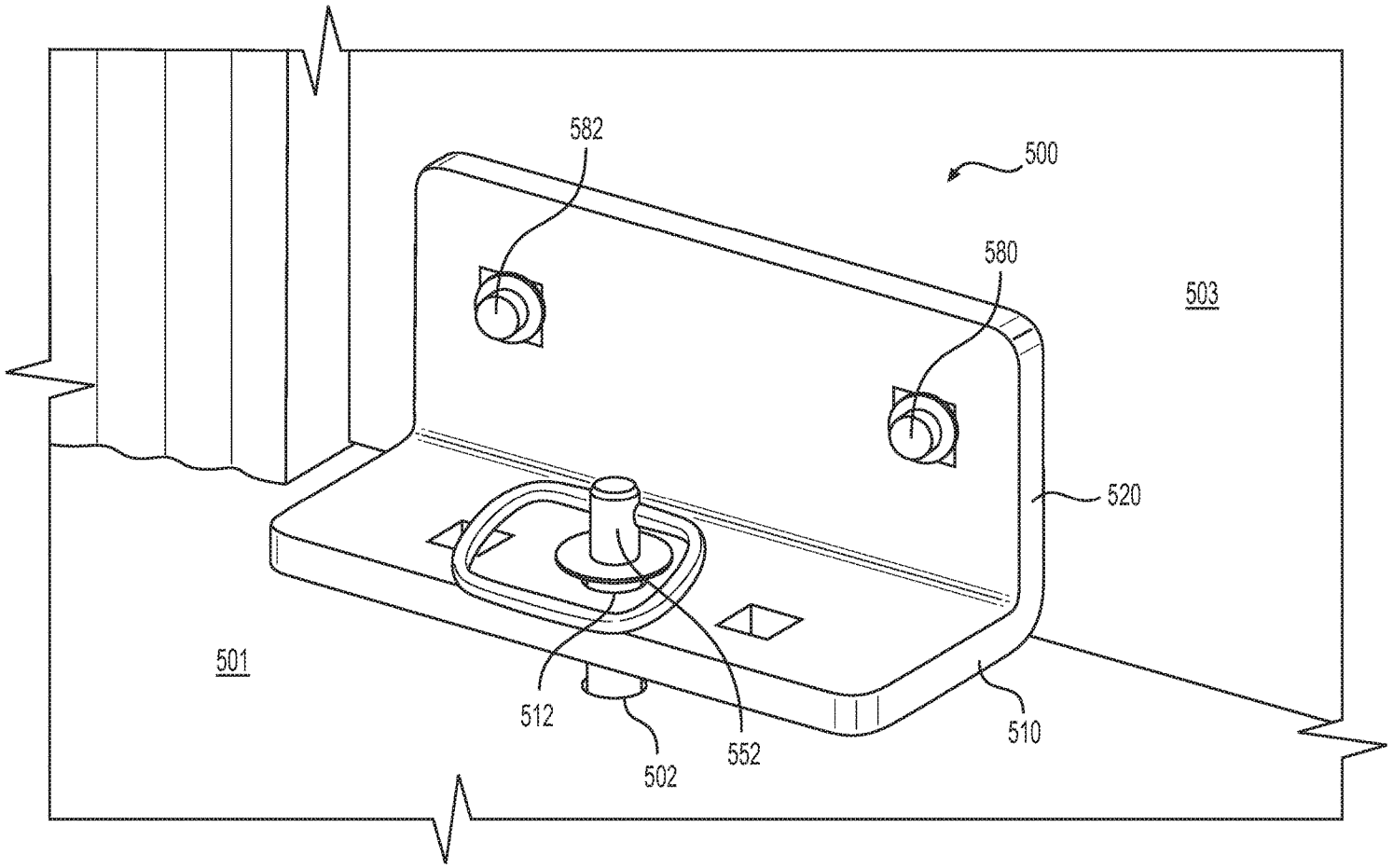
FIG. 19 is a perspective view of still yet another embodiment of a door lock engaged with a door and the floor.
Figure 20:
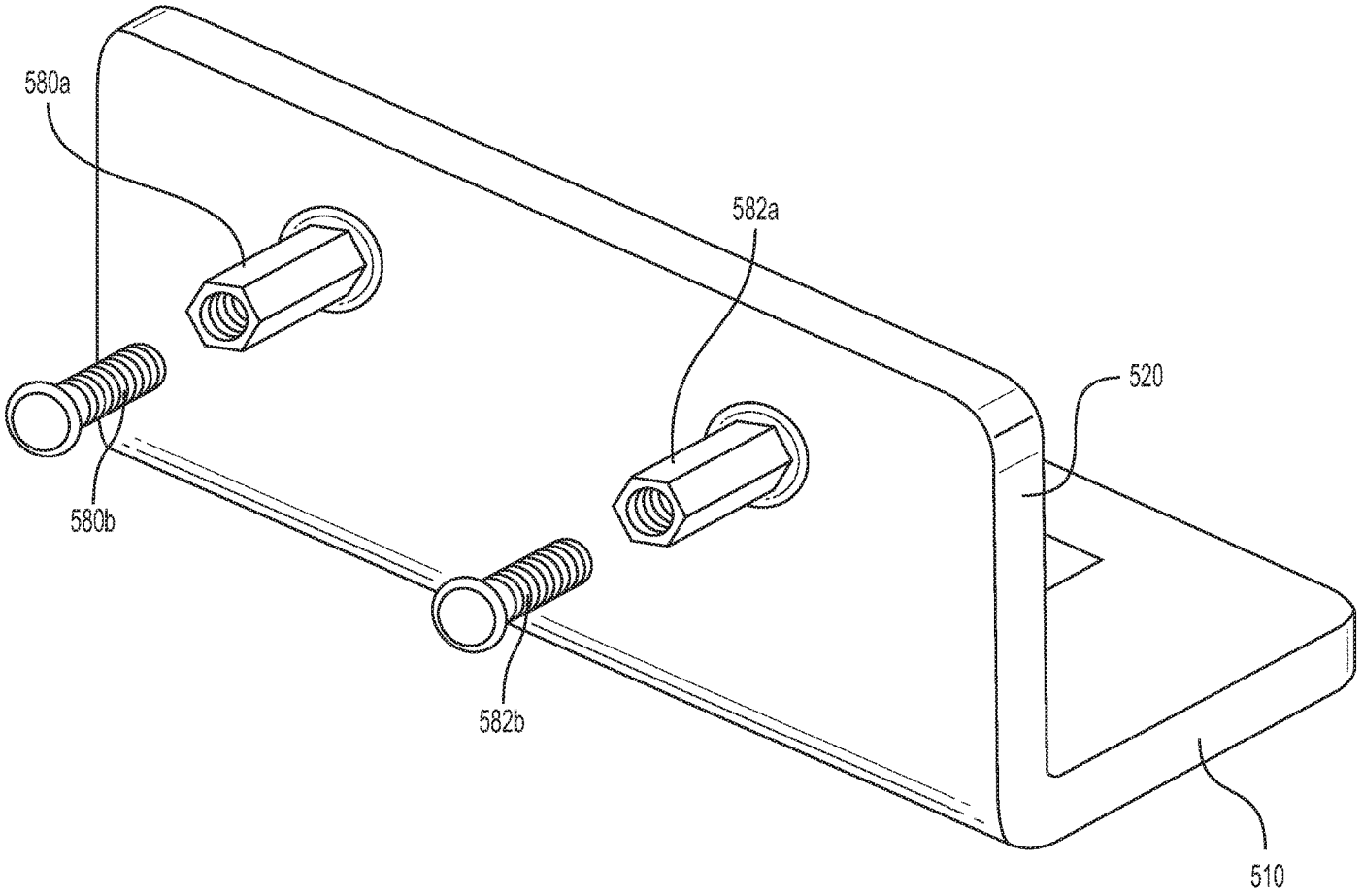
FIG. 20 is a perspective view of a back of the door lock of FIG. 19.
Figure 21:
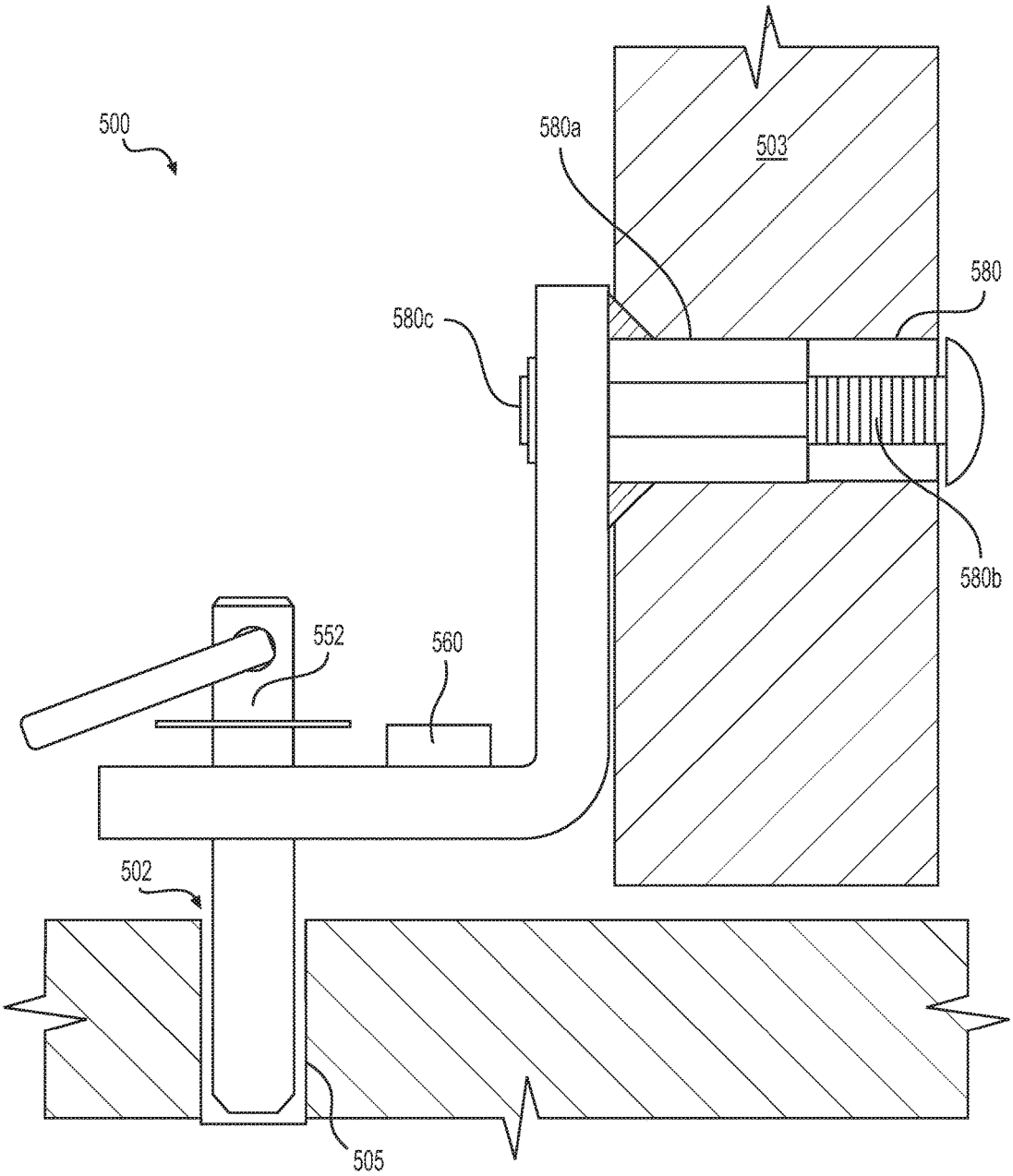
FIG. 21 is a sectional view of the embodiment of FIG. 19, shown engaged with the door and the floor surface.

The embodiments previously discussed are portable, wedge-shaped embodiments that are not intended to be continuously engaged with the door 20. As shown in FIGS. 19-21, another embodiment of a door lock 500 is permanently attached to a door 503. The door lock 500 has a floor engaging member 510, an upright member 520, a pin 552, and a hole 512. The door lock 500 may also have a magnet 560 fixed to the floor engaging member 510. As shown in FIG. 21, the magnet 560 may be fixed to the floor engaging member 510 near the upright member 520. The magnet 560 may alternately abut the upright member 520, or may be spaced closer to the hole 512. The magnet 520 may be used to bias the pin 552 to the floor engaging member 510 using a magnetic field when the pin 552 is not engaged with the floor surface 501; this may allow for easy storage of the pin 552. The magnetic field caused by the magnet 520 may also interact with the pin 552 and bias the pin 552 to the floor engaging member 510 while the pin 552 passes through the hole 512 and engages the floor engaging member 510 to the floor surface 501. The magnet 560 may be round, square, rectangular, triangular, or any other desired shape. The magnet 560 may be attached to the floor engaging member 510 by adhesive, bolting, welding, or any appropriate method known in the art.

It may be desirable for the door lock 500 to only have one pin 552 because the benefits associated with dual pins as mentioned in the previously discussed embodiments do not apply to the fixed door lock 500 as there is no risk of dislodging the door lock 500 by pivoting. A single pin 552 may reduce the potential for misalignment between the hole 512 and a floor aperture 502. Further, use of a single pin 552 may increase ease of use and decrease an amount of time needed to engage the door lock 500.

As shown in FIG. 19, the door lock 500 is bolted to the door 503 by attachment members 580, 582. It is foreseen that the door lock 500 may be attached to the door by other means, i.e. fasteners, bolts, screws, or other means known in the art. Referring to FIG. 20, couplers 580*a*, 582*a* extend from a back of the upright member 520. The couplers 580*a*, 582*a* may be constructed of any appropriate material, such as steel, aluminum, and other materials and composites. The couplers 580*a*, 582*a* may be attached to the upright member 510 (e.g., by adhesive, welding, bolting, etc.) or may be formed integrally with the upright member 510. The couplers 580*a*, 582*a* may be threaded and configured to receive bolts 580*b*, 582*b*.

Referring to FIG. 21, when engaged, the pin 552 is inserted through the hole 512 and into the aperture 502 in the floor surface 501 to lock the door 503 in place. A steel sleeve may be placed in the floor aperture 502 to secure the aperture 502 and provide an interior for engaging with the pin 552. The steel sleeve may further aid in keeping the pin 552 secure when engaged with a floor surface 501. The steel sleeve may interact with a cover when the pin 552 is not engaged to keep dirt and debris from entering the interior.

The attachment members 580, 582 may extend through a width of the door 503. The door lock 500 is attached to the door 503 by the couplers 580*a*, 582*a* and bolts 580*b*, 582*b*. The bolts 580*b*, 582*b* may be tamper resistant. Use of tamper resistant bolts 580*b*, 582*b* reduces a risk that the door lock 500 may be removed by an intruder. The couplers 580*a*, 582*a* are generally parallel to one another, and are generally perpendicular to the upright member 520. The couplers 580*a*, 582*a* may extend between one and three inches from the upright member 520. It is foreseen that attachment members 580, 582 may not extend through the width of the door 503.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. It will be understood that certain features and subcombinations are of utility and may be employed without reference to other features and subcombinations and are contemplated within the scope of the claims. Various steps in describing methods may be undertaken simultaneously or in other orders than specifically provided.

The invention claimed is:

1. A door lock, comprising:

a base having an abutting end and an engaging end, the engaging end being wider than the abutting end, the abutting end extending rectangularly from the engaging end such that the base maintains a uniform width from the engaging end through the abutting end and ends at the abutting end, a pair of holes being disposed in the engaging end;

a wedge permanently immovable relative to and extending upwardly from the base, a tapered end of the wedge being relatively distal to the engaging end, a raised end of the wedge being relatively proximal to the engaging end and terminating along the base before reaching the engaging end;

a magnet positioned on the base between the pair of holes, the magnet imparting a magnetic field above the engaging end; and a first pin and a second pin, each of the first pin and the second pin configured to pass through a respective hole of one of the pair of holes and an aperture in a floor surface to temporarily secure the base to the floor surface while a bottom face of the base rests on the floor surface, the first pin and the second pin being coupled together in a U-shape, wherein the magnetic field biases the first pin and the second pin to the base when the first pin and the second pin temporarily secure the base to the floor surface;

wherein an outermost edge of each hole of the pair of holes is laterally outside opposite sides of the wedge.

2. The door lock of claim 1, wherein the engaging end includes a handle extending upwardly above the magnet and below an upper-most point of the wedge.

3. The door lock of claim 2, wherein the handle extends upwardly from the base at an angle between 25 and 85 degrees from horizontal.

4. The door lock of claim 1, wherein the wedge is positioned between the first pin and the second pin when the first pin and the second pin are separated from the pair of holes in the base and biased to the base by the magnetic field.

5. The door lock of claim 1, wherein the first pin and the second pin are outwardly adjacent the opposite sides of the wedge when the first pin and the second pin are separated from the pair of holes in the base and biased to the base by the magnetic field.

6. The door lock of claim 1, wherein the magnet extends upwardly from the base.

7. The door lock of claim 1, wherein:

the first pin and the second pin each have a stop configured to interact with an upper surface of the engaging end without passing through the respective hole of one of the pair of holes when the first pin and the second pin temporarily secure the base to the floor surface; and the magnetic field biases the stops to the upper surface of the engaging end when the first pin and the second pin temporarily secure the engaging end to the floor surface.

8. The door lock of claim 1, wherein an innermost edge of each one of the pair of holes is laterally inside opposite sides of the abutting end.

9. The door lock of claim 1, wherein the engaging end has a forward edge that is generally perpendicular to opposite sides of the abutting end.

10. The door lock of claim 1, wherein the wedge is hollow.

11. The door lock of claim 1, wherein the abutting end is tapered.

12. The door lock of claim 1, wherein the engaging end is V-shaped.

13. A door lock, comprising:

a base having an abutting end and an engaging end, the engaging end being wider than the abutting end, a pair of holes being disposed in the engaging end;

a wedge extending upwardly from the base, a tapered end of the wedge being generally adjacent the abutting end, the abutting end having a maximum width that does not exceed a width of the base lowerly adjacent the wedge, the wedge permanently immovable relative to the base;

a first pin and a second pin coupled to one another, each of the first pin and the second pin configured to pass through a respective hole of the pair of holes and then an aperture in a floor surface to temporarily secure the base to the floor surface with an uppermost edge of each of the first pin and the second pin being below an apex of the wedge, the first pin and second pin coupled together to form a U-shape; and a magnet imparting a magnetic field above the engaging end to selectively bias the first pin and the second pin to the base while the first pin and the second pin secure the base to the floor surface;

wherein the wedge is positioned between the first pin and the second pin when the first pin and the second pin are at a storage configuration, the first pin and the second pin being biased to the base by the magnetic field when at the storage configuration.

14. The door lock of claim 13, wherein the engaging end includes a handle extending upwardly above the magnet and below the apex of the wedge.

15. The door lock of claim 14, wherein an innermost edge of each hole of the pair of holes is laterally inside opposite sides of the abutting end.

16. The door lock of claim 15, wherein the magnet is between the pair of holes in the base.

17. The door lock of claim 16, wherein the wedge is hollow.

18. A door lock, comprising:

a base having an abutting end and an engaging end, a pair of holes being disposed in the engaging end;

a magnet positioned on the base between the pair of holes, the magnet imparting a magnetic field above the engaging end;

a first pin and a second pin, each of the first pin and the second pin configured to pass through a respective hole of one of the pair of holes and an aperture in a floor surface to temporarily secure the base to the floor surface while a bottom face of the base rests on the floor surface; and a wedge extending upwardly from the abutting end, the wedge being permanently immovable relative to the base and having a generally planar top face angled relative to the bottom face of the base, a tapered end of the wedge being relatively distal to the engaging end, a raised end of the wedge being relatively proximal to the engaging end, the raised end of the wedge being sequentially between the pair of holes and the tapered end of the wedge;

wherein an outermost edge of each hole of the pair of holes is laterally outside opposite sides of the generally planar top face of the wedge;

wherein the first pin and the second pin are coupled together in a U-shape;

wherein the first pin and the second pin each have a stop configured to limit travel of the first pin and the second pin pins through the respective hole of the pair of holes when the first pin and the second pin temporarily secure the base to the floor surface; and wherein the magnetic field of the magnet biases the first pin and the second pin to the base when the first pin and the second pin temporarily secure the base to the floor surface.

* * * * *